US009157595B2

(12) United States Patent
Hager et al.

(10) Patent No.: US 9,157,595 B2
(45) Date of Patent: Oct. 13, 2015

(54) LIGHT-EMITTING DEVICE HAVING MULTIPLE LIGHT SOURCE GROUPS

(75) Inventors: Juergen Hager, Herbrechtingen (DE); Oliver Hering, Niederstotzingen (DE); Ralf Vollmer, Ulm (DE)

(73) Assignee: OSRAM GmbH, Munich (DE)

( * ) Notice: Subject to any disclaimer, the term of this patent is extended or adjusted under 35 U.S.C. 154(b) by 68 days.

(21) Appl. No.: 13/822,322

(22) PCT Filed: Aug. 23, 2011

(86) PCT No.: PCT/EP2011/064441

§ 371 (c)(1), (2), (4) Date: Mar. 12, 2013

(87) PCT Pub. No.: WO2012/038173

PCT Pub. Date: Mar. 29, 2012

(65) Prior Publication Data

US 2013/0194816 A1 Aug. 1, 2013

(30) Foreign Application Priority Data

Sep. 21, 2010 (DE) ..... 10 2010 041 096

(51) Int. Cl.
*H01J 17/24* (2012.01)
*F21S 8/10* (2006.01)

(52) U.S. Cl.
CPC ..... *F21S 48/13* (2013.01); *F21S 48/115* (2013.01); *F21S 48/1154* (2013.01); *F21S 48/1225* (2013.01); *F21S 48/1241* (2013.01); *F21S 48/1388* (2013.01); *F21S 48/145* (2013.01)

(58) Field of Classification Search
CPC ..... F21S 48/13; F21S 48/115
USPC ..... 362/555
See application file for complete search history.

(56) References Cited

U.S. PATENT DOCUMENTS

| | | | | |
|---|---|---|---|---|
| 7,156,544 | B2 | 1/2007 | Ishida | |
| 7,401,947 | B2 | 7/2008 | Wanninger et al. | |
| 7,611,272 | B2 | 11/2009 | Specht et al. | |
| 7,726,859 | B2 | 6/2010 | Naganawa et al. | |
| 2005/0068787 | A1 * | 3/2005 | Ishida | 362/538 |

(Continued)

FOREIGN PATENT DOCUMENTS

| | | | |
|---|---|---|---|
| DE | 10065020 | A1 | 3/2002 |
| DE | 10105303 | A1 * | 8/2002 |

(Continued)

OTHER PUBLICATIONS

English translation of DE 10105303 (Aug. 2002).*

(Continued)

*Primary Examiner* — Mary Ellen Bowman
*Assistant Examiner* — Hana Featherly

(57) ABSTRACT

A light-emitting device may include: one first light source group having at least one light source and one second light source group having at least one light source, at least one reflector, which is configured and arranged for the purpose of reflecting light emitted by the first light source group to an optical plane, and at least one light conducting element, which is configured and arranged for the purpose of conducting light emitted by the second light source group to the optical plane, wherein the light conducting element is configured and arranged as an aperture for light reflected by the at least one reflector.

14 Claims, 3 Drawing Sheets

(56) References Cited

U.S. PATENT DOCUMENTS

| | | | |
|---|---|---|---|
| 2008/0068852 | A1 | 3/2008 | Goihl |
| 2010/0226142 | A1 | 9/2010 | Brendle et al. |

FOREIGN PATENT DOCUMENTS

| | | | |
|---|---|---|---|
| DE | 20211305 | U1 | 10/2002 |
| DE | 10314350 | A1 | 10/2004 |
| DE | 102005017528 | A1 | 3/2006 |
| DE | 102008015510 | A1 | 10/2008 |
| EP | 1500869 | A1 | 1/2005 |
| EP | 1903274 | A1 | 3/2008 |
| FR | 2860280 | A1 | 4/2005 |
| GB | 2405755 | A | 3/2005 |

OTHER PUBLICATIONS

English language abstract of EP 1500869 EP dated Jan. 26, 2005.
English language abstract of DE 10314350A1 dated Oct. 14, 2004.
English language abstract of DE 10065020 A1 dated Mar. 14, 2002.
Office Action issued in the corresponding Chinese application No. 201180028249.8, dated Jul. 3, 2014 (with English translation).

* cited by examiner

LIGHT-EMITTING DEVICE HAVING MULTIPLE LIGHT SOURCE GROUPS

RELATED APPLICATIONS

The present application is a national stage entry according to 35 U.S.C. §371 of PCT application No.: PCT/EP2011/064441 filed on Aug. 23, 2011, which claims priority from German application No.: 10 2010 041 096.9 filed on Sep. 21, 2010.

TECHNICAL FIELD

Various embodiments relate to a light-emitting device, e.g. an automobile light-emitting device, which has a light source group having at least one light source, and also has a reflector, which is configured and arranged for the purpose of reflecting light emitted by the light source group to an optical plane.

BACKGROUND

DE 10 2008 015 510 A1 discloses a light-emitting unit of a vehicle headlight, having: a projector lens having an optical axis; a light source, which includes a semiconductor light emitter element; a first reflector, which reflects light from the light source so that the light converges on the optical axis or in proximity thereto; and a screen, which is arranged between the light source and the projector lens so that it extends in the direction of the optical axis. The screen screens off a part of the light reflected from the first reflector. In the light-emitting unit of the vehicle headlight, a screen surface extends to the rear from a front end of the screen, where the screen is arranged in proximity to a rear focal point of the projector lens. The screen surface is used as a second reflector, which reflects light from the first reflector to the projector lens. Furthermore, a transparent section is provided on a part of the second reflector so that a part of the light which is reflected from the first reflector passes below the rear focal point of the projector lens, and is then incident on the projector lens.

SUMMARY

Various embodiments provide a light-emitting device, e.g. an automobile light-emitting device, which may at least partially overcome the disadvantages of the prior art, and e.g. may provide a compact and robust light-emitting device having an alternately changeable light distribution pattern.

Various embodiments provide a light-emitting device, having at least one first light source group having at least one light source and one second light source group having at least one light source, and at least one reflector, which is configured and arranged for the purpose of reflecting light emitted by the first light source group to an optical plane, and also at least one light conducting element, which is configured and arranged for the purpose of conducting light emitted by the second light source group to the optical plane, wherein the light conducting element is configured and arranged as an aperture for light reflected by the reflector.

This light-emitting device has the advantage that, through the second light source group, a light bundle can be generated on the optical plane (or intermediate plane) which is not shadowed and which can be precisely shaped by the light conducting element. The further advantage results that the light conducting element itself is used as an aperture or shutter for the light reflected from the first light source group via the reflector, and a separate aperture can therefore be omitted. For example, a sharp light/dark boundary can be generated by the aperture function of the light conducting element. A light bundle, which can be formed flexibly, and fanned out widely, and which has a brightness distribution settable in a targeted manner, is in turn made possible by the reflector.

This light-emitting device is particularly configured for the purpose of alternately activating the light source groups, so that various light distributions are implementable in a very compact manner. The first light source group can therefore have one or more jointly activatable light sources, similarly, the second light source group can have one or more jointly activatable light sources. The light source groups are alternately activatable, specifically individually and/or in combination.

However, the light-emitting device is not restricted to two light source groups, but rather can have still further light source groups. In particular, light can be emitted by one or more further light source groups onto the reflector or conducted by a further light conducting element to the optical plane. Still further light distributions may thus be implemented.

In one embodiment, the light-emitting device has at least one optical imaging element for imaging the optical plane. The imaging element is therefore connected downstream from the optical plane. The image generated in the optical plane is generated by means of the light source groups individually or in combination. The at least one imaging element may include a lens and/or a collimator, for example.

In one embodiment, the light conducting element is configured for the purpose of conducting light essentially perpendicularly onto the optical plane. A high light intensity can thus be achieved along an optical axis of the light-emitting device, for example to generate a broad-beamed high beam component of a headlight. However, the light-emitting device is not restricted thereto, and the light conducting element can also conduct the light emitted by the second light source group diagonally onto the optical plane, but not parallel to the optical plane. In a refinement, the angle of the light emitted by the at least one optical light conducting element onto the optical plane in relation to a surface normal of the optical plane is not more than 45°, in particular not more than 30°, in particular not more than 10°.

In another embodiment, the reflector and the light conducting element end substantially at the optical plane. Particularly precise beam guiding and image buildup in the optical plane can thus be achieved.

In another embodiment, the light conducting element is mirrored at least in a region on which it can be irradiated with light by the first light source group. This results in the advantage that light from the first light source group cannot be coupled into the light conducting element and therefore light conduction of the light of the two light source groups remains separate, which improves image sharpness.

In a refinement, the light conducting element is configured and arranged for the purpose of reflecting light incident from the first light source group onto the reflector using its mirrored region. A light yield can thus be increased.

In a further refinement, the light conducting element (except for a light entry region or light entry surface for coupling in the light emitted by the second light source group and except for a light exit region or light exit surface for coupling out the conducted light to the optical plane) is substantially completely mirrored. External coupling in of light which is not generated by the second light source group can thus be particularly effectively prevented. In addition, a loss of light conducted by the light conducting element can be decreased by the mirroring, for example, if the light guided in the light conducting element would suffer significant losses with solely an interior total reflection. In other words, a less effective interior total reflection can be compensated for by the mirroring.

However, the light conducting element does not need to be mirrored, but rather may also allow light conduction solely through interior total reflection. Incidence of light from the first light source group can also be prevented by exterior total reflection.

In another embodiment, the at least one light conducting element includes at least one non-imaging optical element. A non-imaging optical element has the advantage that it allows a high beam concentration while maintaining the etendue. A highly uniform illumination is also obtained at the light exit region.

In another embodiment, the at least one non-imaging optical element includes at least one optical waveguide. The optical waveguide allows precise conduction of the light to the optical plane and optionally precisely defined beam widening. In addition, an optical waveguide can be made flexible in terms of design and is also producible comparatively cost-effectively.

In an alternative or (for the case of multiple light source groups whose light is guided by a respective light conducting element to the optical plane) additional embodiment, the at least one non-imaging optical element comprises at least one concentrator. The concentrators allow a particularly good light yield. The at least one concentrator may include a compound parabolic concentrator (CPC) or a compound elliptical concentrator (CEC), for example.

In another embodiment, at least one deflection element, which deflects light oriented on the light conducting element onto the reflector, is connected downstream from the first light source group. Irradiation of light of the first light source group on the light conducting element, and therefore possible coupling in of interfering light, can thus be suppressed. In addition, a separate embodiment or shaping of the light or light bundle emitted by the first light source group and the shape of the light conducting element is possible, which allows greater design flexibility. The deflection element can be a reflector, for example, in particular a miniaturized reflector.

In a further embodiment, the at least one light source of the first light source group and the at least one light source of the second light source group are aligned perpendicularly to the optical plane. This allows, for example, a particularly simple embodiment of the light conducting element as a concentrator. In particular for this case, a deflection element can be connected downstream from the first light source group (i.e., the associated at least one light source), in order to conduct a large component of the light emitted by the first light source group onto the reflector and to suppress direct irradiation on the optical plane (which can in particular lie on a reflector opening).

In another embodiment, the at least one light source of the first light source group and the at least one light source of the second light source group are aligned parallel to the optical plane. Irradiation of the reflector is thus simplified, for example by omitting a deflection element.

In another embodiment, the at least one light source of the first light source group and the at least one light source of the second light source group are semiconductor light sources.

The at least one semiconductor light source preferably includes at least one light-emitting diode. If multiple light-emitting diodes are provided, they can emit light in the same color or in various colors. A color can be monochromic (e.g., red, green, blue, etc.) or multichromic (e.g., white). The light emitted by the at least one light-emitting diode can also be infrared light (IR LED) or ultraviolet light (UV LED). Multiple light-emitting diodes can generate a mixed light; e.g., a white mixed light. The at least one light-emitting diode can contain at least one wavelength-converting fluorescent substance (conversion LED). The at least one light-emitting diode can be provided in the form of at least one single housed light-emitting diode or in the form of at least one LED chip. Multiple LED chips can be installed on a shared substrate ("submount"). The at least one light-emitting diode can be equipped with at least one separate and/or shared optic for beam guidance, e.g., at least one Fresnel lens, collimator, etc. Instead of or in addition to inorganic light-emitting diodes, e.g., based on InGaN or AlInGaP, organic LEDs (OLEDs, e.g., polymer OLEDs) are generally also usable. Alternatively, the at least one semiconductor light source can be, e.g., a laser diode.

In still a further embodiment, the light-emitting device is an automobile light-emitting device, (i.e., a light-emitting device which is used in particular in the automotive field). The automobile light-emitting device can in particular be a headlight. The first light source group can in particular generate a low beam, a light conducting element in the optical path of the light generated by the first light source group being used as an aperture for generating an associated light/dark boundary. The light sources of the second light source group are turned off for the low beam function.

To generate a high beam by means of the same light-emitting device, the light sources of the second light source group are switched on, and can illuminate a region which is not illuminated by the first light source group because of the aperture affect by the light conducting element.

BRIEF DESCRIPTION OF THE DRAWINGS

In the following figures, the invention is described in greater detail schematically on the basis of exemplary embodiments. Identical or identically acting elements may be provided with identical reference signs for comprehensibility.

DETAILED DESCRIPTION

The following detailed description refers to the accompanying drawings that show, by way of illustration, specific details and embodiments in which the invention may be practiced.

Figure 1:
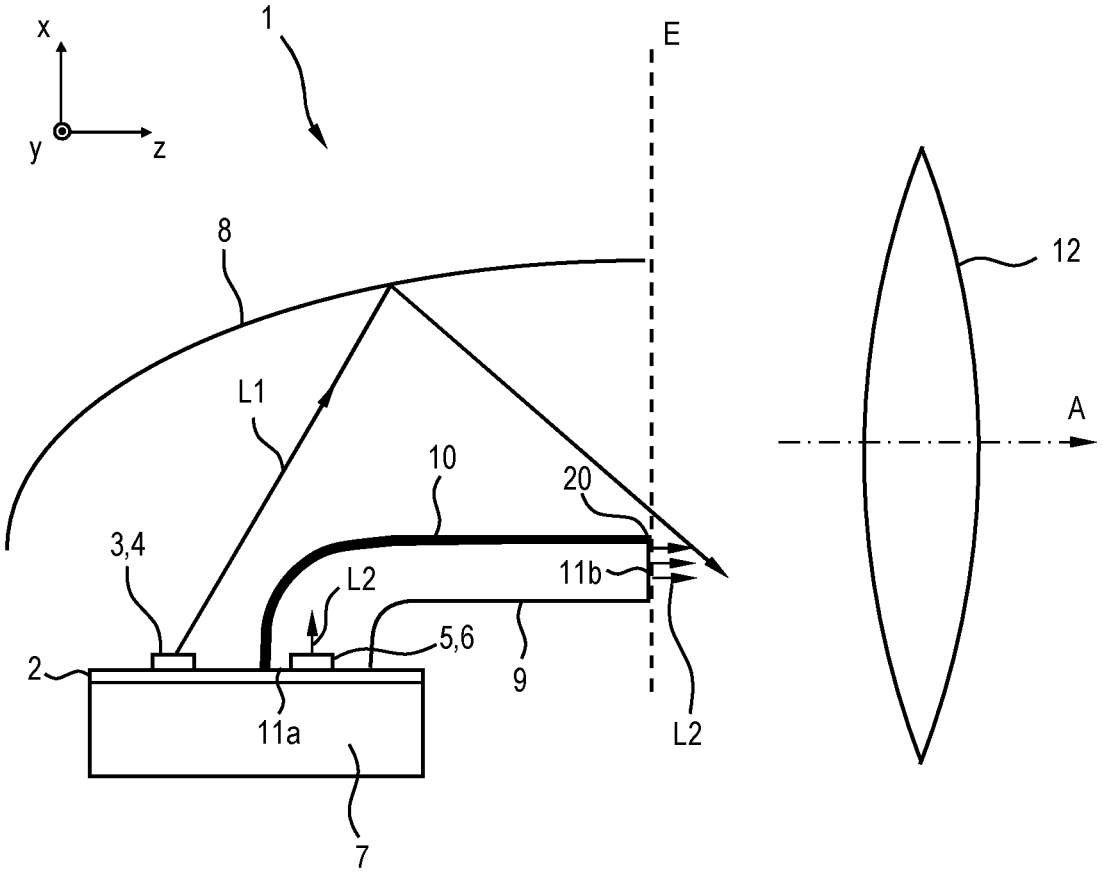
FIG. 1 shows a sectional illustration in a side view of a light-emitting device according to a first embodiment.

FIG. 1 shows a light-emitting device 1 in the form of an automobile headlight. The light-emitting device 1 has a substrate in the form of a printed circuit board 2, which is equipped with at least one light-emitting diode 3 of a first light source group 4 and with at least one light-emitting diode 5 of a second light source group 6. The at least one light-emitting diode 3 and the at least one light-emitting diode 5 can be of the same or different types.

The substrate 2 lies horizontally (i.e., in a (y, z) plane), so that the light-emitting diodes 3 and 5 are aligned perpendicularly (i.e., in the x direction). In other words, the optical axis or axis of symmetry of the light bundle generated by the light-emitting diodes 3 and 5 is aligned vertically. While the light-emitting diodes 3, 5 are attached on the front side of the substrate 2, the rear side of the substrate 2 can rest on a cooling body 7.

A reflector 8 is located in the emission direction of the light L1 emitted by the at least one light-emitting diode 3, i.e., in an optical path of the light bundle emitted by the at least one light-emitting diode 3. The reflector 8 arches over the light-emitting diodes 3 here. A majority of the light emitted by the at least one light-emitting diode 3 is thus incident directly on the reflector 8 and is deflected laterally therefrom in the direction of an intermediate plane or optical plane E.

The optical plane E corresponds here to an edge of the reflector 8 and therefore to its light exit plane.

The light reflected by the reflector 8 largely runs directly toward the optical plane E, specifically oriented downward. A light distribution pattern required for low beams can thus be generated. However, a part of the light reflected by the reflector 8 is also incident on a light conductor 9. The light conductor 9 is therefore used as an aperture element for the light L1 reflected by the reflector 8. A light/dark boundary can thus be provided by the light conducting element 9, which boundary is formed by a front top edge 20 of the light conducting element 9.

For an elevated light yield and to prevent the light L1 reflected by the reflector 8 from being able to enter the light conducting element 9, the light conducting element 9 has a mirrored layer 10 at least on its top side. The mirrored layer 10 also causes the light L1 emitted laterally directly onto the light conducting element 9 from the light-emitting diode 3 to be reflected onto the reflector 8 and to be reflected therefrom back in the direction of the optical plane E. The light-emitting device 1 can be designed and arranged so that a component of the light emitted by the light-emitting diode 3 is radiated directly onto the optical plane E. Alternatively, the light-emitting device 1 can be designed so that light emitted by the at least one light-emitting diode 3 is not directly incident on the optical plane E.

The light-source-side end 11*a* of the light conducting element 9 arches over the at least one light-emitting diode 5 of the second light source group 6. Virtually all of the light L2 emitted by the at least one light-emitting diode 5 can thus be coupled into the light conductor 9, which conducts this light L2 up to a front light exit surface 11*b* in its interior. The light exit surface 11*b* borders flush with the surface on the optical plane E and runs horizontally thereon at least in its last section. A light spot, which is determined by the extension of the light conductor 9 and is substantially homogeneous with respect to its brightness, is thus generated in the optical plane E. The light L2 of this light spot is not shadowed and can in particular be generated to generate a comparatively strongly bundled and bright light beam, in particular to generate a high beam. The light conducting element 9 is formed as a rigid element, for example using Plexiglas, and is therefore robust, precise, and easily installable.

The light conducting element 9 is therefore used, on the one hand, to implement a light conduction function for the at least one light-emitting diode 5 of the second light source group 6 and also as an aperture for the light L1 emitted by the at least one light-emitting diode 3 of the first light source group 4. This double function allows a particularly compact and cost-effective light-emitting device 1.

At least one optical imaging element 12, in this case for example a lens, is connected downstream from the optical plane E, which lens images the image appearing in the optical plane E on a desired imaging region, for example on a region of a road. An optical axis A of the light-emitting device 1 can also be defined by the lens.

Figure 2:
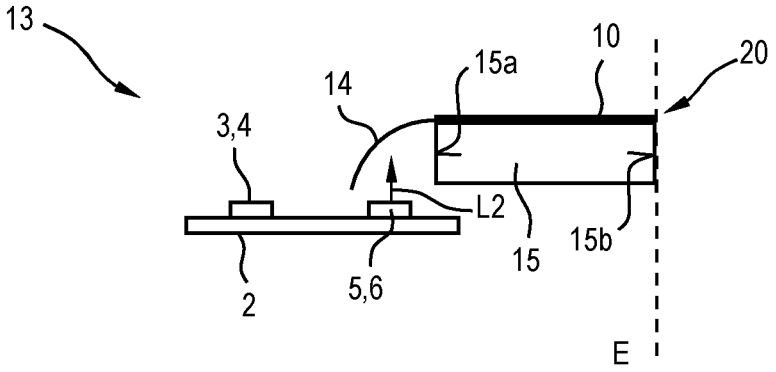
FIG. 2 shows a sectional illustration in a side view of a light conducting element of a light-emitting device according to a second embodiment.

FIG. 2 shows components of a light-emitting device 13 according to a second embodiment, which is similar to the light-emitting device 1. However, the light conductor 9 from FIG. 1 has now been replaced by a combination of a deflection element 14, for example a reflector, and a non-curved, for example cuboid, light conducting element 15. In this case, the light L2 emitted by the at least one light-emitting diode 5 is firstly deflected by the deflection element by approximately 90° onto the light conductor 15, so that it is coupled into a light entry surface 15*a* of the light conducting element 15 (which is therefore arranged perpendicularly to the substrate 2). The coupled-in light L2 is conducted inside the light conductor 15 up to a terminal light exit surface 15*b*, which lies surface flush with the optical plane E, similarly to the light exit surface 11*b*. This embodiment allows a simpler embodiment of the light conducting element 15.

Figure 3:
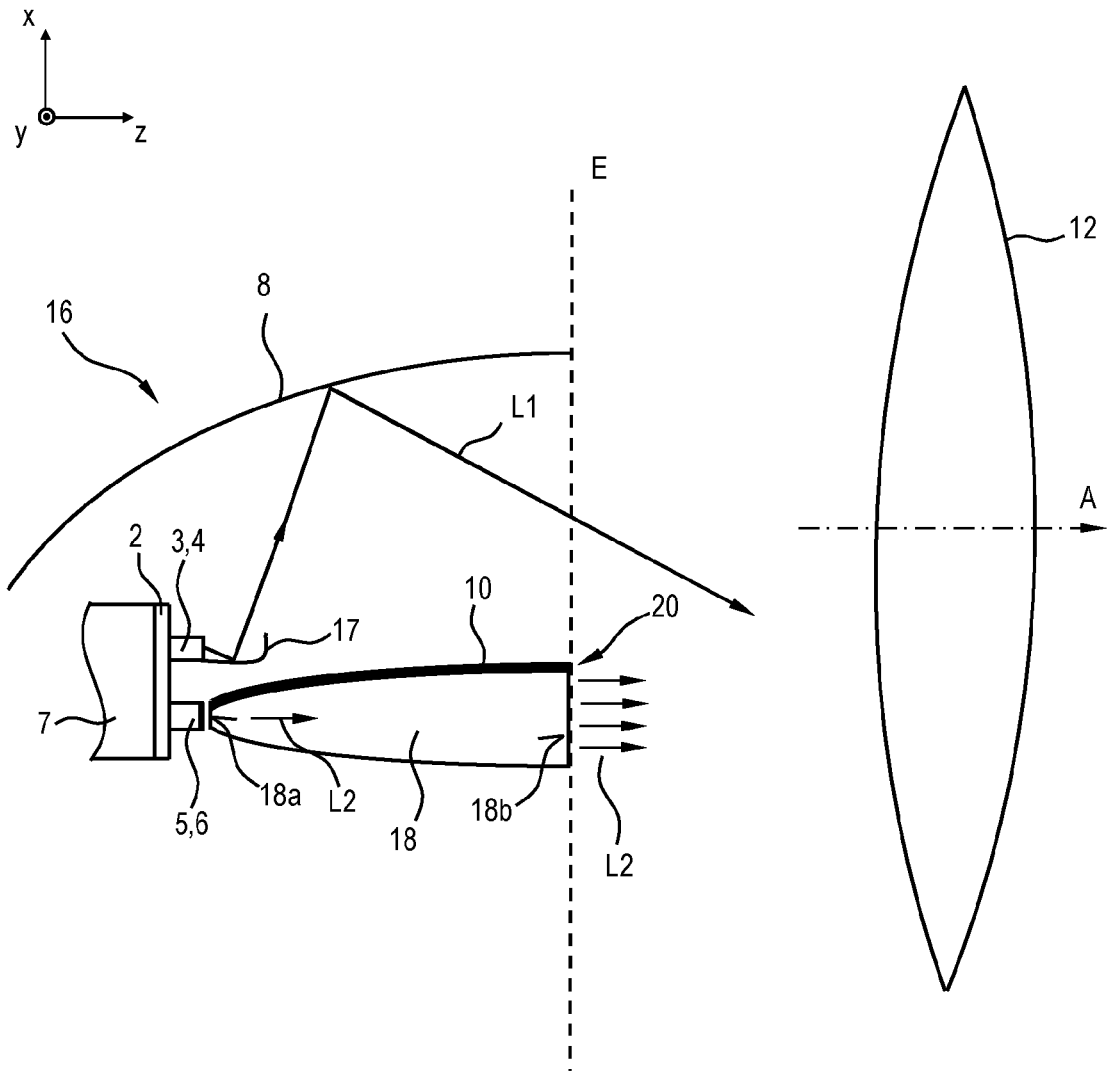
FIG. 3 shows a sectional illustration in a side view of a light-emitting device according to a third embodiment.

FIG. 3 shows a light-emitting device 16 according to a third embodiment, in which the light-emitting diodes 3 and 5 are now aligned horizontally, i.e., in the z direction. The substrate 2 bearing the light-emitting diodes 3 and 5 is accordingly arranged standing upright. In order that the light L1 emitted by the at least one light-emitting diode 3 of the first light source group 4 is not radiated directly into the optical plane E, a deflection element 17 in the form of a miniaturized reflector is arranged directly behind the one light-emitting diode 3, which deflection element deflects that component of the light L1 emitted by the at least one light-emitting diode 3 which is not radiated directly onto the reflector 8, onto the reflector 8. Virtually all of the light L1 emitted by the at least one light source 3 is therefore deflected onto the reflector 8. The light L1 reflected by the reflector 8 is predominantly incident directly on the optical plane E and is thus reflected by the reflector 8 directly out of its light exit plane. A part of the light L1 reflected by the reflector 8 is also incident on a light conducting element 18, which is equipped with a mirrored layer 19 on its top side facing toward the reflector 8, however. The mirrored layer 19 is used for the purpose of preventing entry of the light L1 into the light conducting element 18 and also improving a light yield of the light L1. A front top edge 20 of the light conducting element is used to define a light/dark boundary of the light conducting element 18, which acts as an aperture with regard to the light L1.

The light conducting element 18 is designed here in the form of a CPC element or a compound parabolic concentrator, which couples in light emitted by the at least one light-emitting diode 5 of the light source group 6 on its light entry surface 18*a* and conducts it to its light exit surface 18*b*, which lies surface flush with, in particular in, the optical plane E. The light L2 exiting from the light exit surface 18*b* is highly homogeneous and parallelized because of the maintenance of the etendue caused by the concentrator. Alternatively, the exiting light also may not run parallel, but may also be concentrated, etc., for example.

An optical imaging element 12 in the form of a lens for imaging the light pattern formed in the optical plane E is also connected downstream from the optical plane E here.

Figure 4:
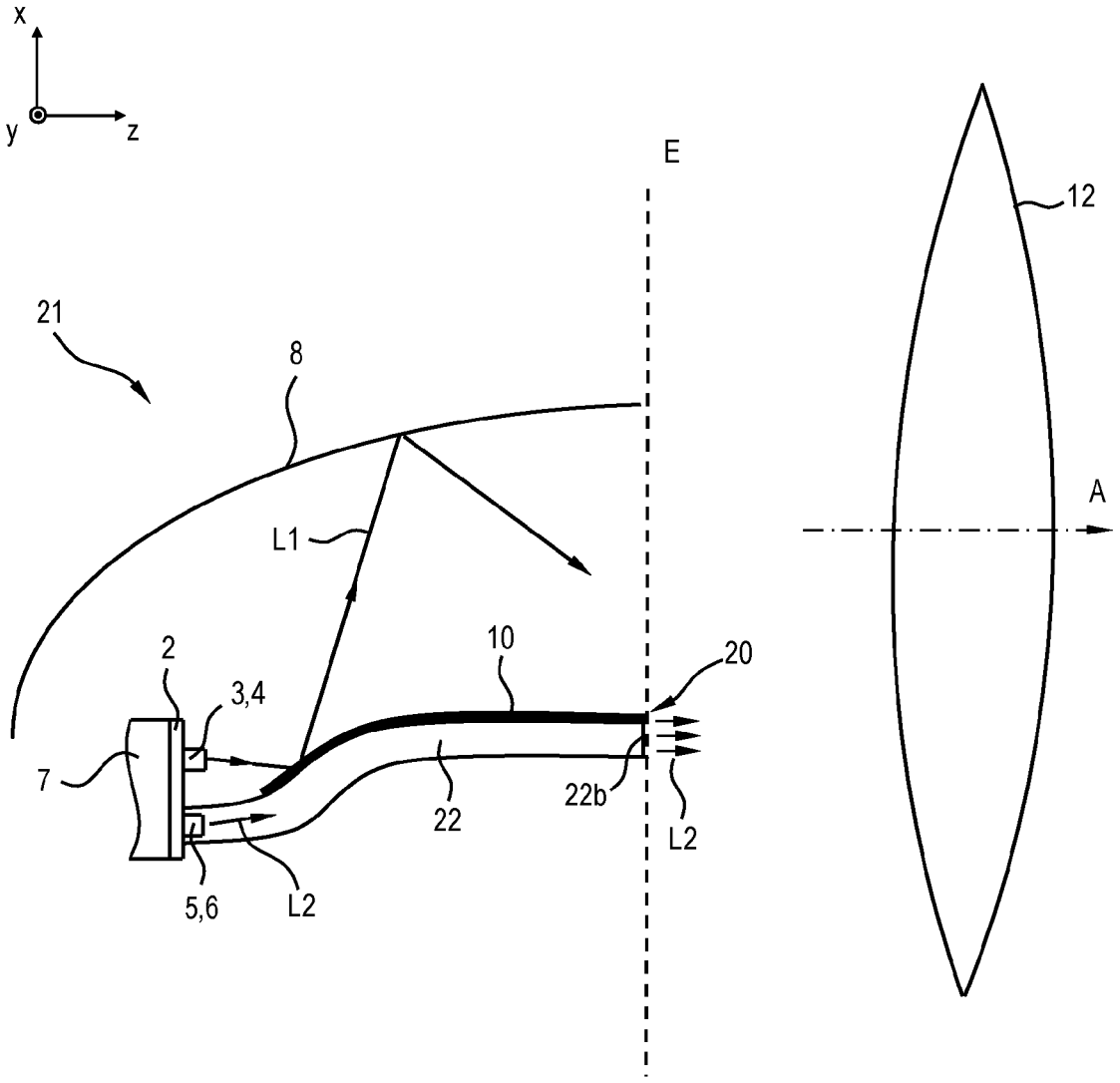
FIG. 4 shows a sectional illustration in a side view of a light-emitting device according to a fourth embodiment.

FIG. 4 shows a light-emitting device 21 according to a fourth embodiment similar to the light-emitting device 16, the light conducting element 22 now being provided in the form of a bent or curved light conductor. The light conducting element 22 again conducts the light emitted by the at least one light-emitting diode 5 of the second light source group 6 to the optical plane E, where it exits from a light exit surface 22*b*.

The light-emitting diodes 3 and 5 are aligned horizontally (in the z direction) here as in FIG. 3.

In contrast to the light-emitting device 16 from FIG. 3, however, there is no deflection element connected downstream from the at least one light-emitting diode 3 of the first light source group 4, and so a part of the light L1 emitted by the at least one light-emitting diode 3 radiates on the light conducting element 22. The light conducting element 22 is mirrored at least on its top side, on which light L1 can be incident from the at least one light-emitting diode 3. The mirroring can also be implemented here by means of a mirrored layer 10.

The light conducting element 22 is formed, at least in the region in which the light L1 can be incident directly thereon from the at least one light-emitting diode 3, in such a manner, for example in this case curved, so that, for example, the surface of the light conducting element 22 acts there as a reflector surface for the light L1. In other words, the light conducting element 22 is formed optimized for a suitable reflection property in the region of its surface which is directly irradiated by the light L1.

Of course, the present invention is not restricted to the exemplary embodiments shown.

The light conducting elements can thus also be completely mirrored except for their light entry surface and light exit surface, even in regions in which no light emitted by the at least one light-emitting diode of the first light source group is incident thereon. Rather, the mirroring can also or exclusively be used for the purpose of minimizing light losses of the light conducted within the light conducting element, because of scattering into the surroundings. The light conducting element may thus also be made simpler and more cost-effective.

Very generally, the light-emitting device shown is not restricted to the automotive field, but rather can also be extended to other transport means, such as airplanes or helicopters. A use for an outside light or a safety light can also be particularly advantageous.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE NUMERALS

1 light-emitting device
2 substrate
3 light-emitting diode
4 light source group
5 light-emitting diode
6 light source group
7 cooling body
8 reflector
9 light conducting element
10 mirrored layer
11*a* light-source-side end
11*b* light exit surface
12 imaging element
13 light-emitting device
14 deflection element
15 light conducting element
15*a* light entry surface
15*b* light exit surface
16 light-emitting device
17 deflection element
18 light conducting element
18*a* light entry surface
18*b* light exit surface
19 mirrored layer
20 top edge of the light conducting element
21 light-emitting device
22 light conducting element
22*b* light exit surface
A optical axis
E optical plane
L1 light
L2 light

The invention claimed is:

1. A light-emitting device, at least comprising:

one first light source group having at least one light source and one second light source group having at least one light source, at least one reflector, which is configured and arranged for the purpose of reflecting light emitted by the first light source group to an optical plane, and at least one light conducting element, which is configured and arranged for the purpose of conducting light emitted by the second light source group to the optical plane, wherein the light conducting element is configured and arranged as an aperture for light reflected by the at least one reflector, wherein said at least one reflector and said at least one light conducting element end substantially at said optical plane, wherein the light conducting element comprises a light-source-side end and a front light exit surface, wherein said light-source-side end arches over the at least one light source of the second light source group, and said front light exit surfaces borders flush with the optical plane, wherein the light conducting element is configured so that virtually all of the light emitted by the at least one light source of the second light source group is coupled into the light conducting element and conducted to the front light exit surface in its interior.

2. The light-emitting device as claimed in claim 1, wherein the light-emitting device has at least one optical imaging element for imaging the optical plane.

3. The light-emitting device as claimed in claim 2, wherein the light-emitting device has at least one lens for imaging the optical plane.

4. The light-emitting device as claimed in claim 1, wherein the at least one light conducting element is configured for the purpose of conducting light essentially perpendicularly onto the optical plane.

5. The light-emitting device as claimed in claim 1, wherein the at least one light conducting element is mirrored at least in a region which is irradiated with light by the first light source group, and is configured and arranged for the purpose of reflecting light incident from the first light source group onto the reflector.

6. The light-emitting device as claimed in claim 1, wherein the at least one light conducting element comprises at least one non-imaging optical element.

7. The light-emitting device as claimed in claim 6, wherein the at least one non-imaging optical element comprises at least one optical waveguide.

8. The light-emitting device as claimed in claim 6, wherein the at least one non-imaging optical element comprises at least one concentrator.

9. The light-emitting device as claimed in claim 1, wherein at least one deflection element, which deflects light oriented on the light conducting element onto the reflector, is connected downstream from the first light source group.

10. The light-emitting device as claimed in claim 1, wherein the at least one light source of the first light source group and the at least one light source of the second light source group are aligned perpendicularly to the optical plane.

11. The light-emitting device as claimed in claim 1, wherein the at least one light source of the first light source group and the at least one light source of the second light source group are aligned parallel to the optical plane.

12. The light-emitting device as claimed in claim 1, wherein the at least one light source of the first light source group and the at least one light source of the second light source group are semiconductor light sources.

13. The light-emitting device as claimed in claim 12, wherein the at least one light source of the first light source group and the at least one light source of the second light source group are light-emitting diodes.

14. The light-emitting device as claimed in claim 1, wherein the light-emitting device is an automobile light-emitting device, the first light source group generating a low beam and the first light source group and the second light source group jointly generating a high beam.

* * * * *